US006958690B1

(12) United States Patent
Asher et al.

(10) Patent No.: US 6,958,690 B1
(45) **Date of Patent: *Oct. 25, 2005**

(54) METHOD AND APPARATUS FOR MANAGING DIG ALERTS IN A NETWORK SYSTEM

(75) Inventors: Michael L. Asher, Green Grove Springs, FL (US); Udaya Bhaskar Natha, Alpharetta, GA (US); Charles C. Giddens, Conyers, GA (US); Lloyd Lester Magown, Jr., Longview, TX (US); Harold Jeffrey Stewart, Alpharetta, GA (US)

(73) Assignee: AT&T Corp., New York, NY (US)

( * ) Notice: Subject to any disclaimer, the term of this patent is extended or adjusted under 35 U.S.C. 154(b) by 230 days.

This patent is subject to a terminal disclaimer.

(21) Appl. No.: 10/458,351

(22) Filed: Jun. 10, 2003

(51) Int. Cl.[7] ..... G08B 1/00

(52) U.S. Cl. ..... 340/531; 340/310.01; 340/539.13; 340/995.1; 702/5; 702/6

(58) Field of Search ..... 340/531, 310.01, 340/310.06, 539.13, 539.2, 995.1, 540; 702/5, 702/6, 150; 342/22, 82, 89

(56) References Cited

U.S. PATENT DOCUMENTS 6,496,137 B1 * 12/2002 Johansson ..... 342/22
6,751,553 B2 * 6/2004 Young et al. ..... 702/5
6,751,554 B1 * 6/2004 Asher et al. ..... 702/5

* cited by examiner

*Primary Examiner*—Davetta W. Goins
(74) *Attorney, Agent, or Firm*—Hoffmann & Baron, LLP

(57) ABSTRACT

The present invention provides a most efficient, automated, fast and least expensive method and apparatus for processing the dig ticket alerts to prevent damage of underground facilities. All the functions required to process the ticket alerts are handled by one system called the geolink (geographical link to data) fiber integrity, i.e. GFI. The processing includes checking the ticket alerts for a dig location, automatically closing the ticket alerts if the dig location is not touching a cable buffer and forwarding the ticket alerts to the technician responsible for the ticket alert if the dig location is touching the cable buffer. The GFI system will receive and process thousands of dig ticket alerts on a daily basis without depending on any other system.

18 Claims, 15 Drawing Sheets

METHOD AND APPARATUS FOR MANAGING DIG ALERTS IN A NETWORK SYSTEM

FIELD OF THE INVENTION

This invention relates to field of network protection systems. More specifically, the present invention relates to efficiently managing dig alerts received from one call centers to prevent damaging of underground facilities.

BACKGROUND OF THE INVENTION

On a daily basis, cable and network protection centers handle thousands of ticket alerts such as "call before you dig" from one call centers. These ticket alerts have to be received, screened, mapped and distributed. Currently, the users of these protection centers are dependent on several different processors/systems and heavy manual labor to handle/process these ticket alerts. This, of course, takes up a lot of time and is very costly. More importantly, it is very inefficient and error prone which results in a high risk of damaging the underground facilities, such as cable, electric, gas, water, sewer, telecommunications, etc.

Therefore, a need exists for a more efficient method for managing "call before you dig" alerts to prevent these risks of damaging the underground facilities to ensure the stability and integrity of the fiber cables and their facilities underground, eliminating the risk of disrupting service and greatly reducing the potential risk of serious personal injury.

SUMMARY OF THE INVENTION

A system and method for automatically managing ticket alerts to prevent damage of underground facilities is provided. The method comprises receiving ticket alerts from various sources, wherein the ticket alerts comprise a notification of underground excavation. The method also comprises automatically processing the ticket alert in a geolink fiber integrity (GFI) ticket manager application system, wherein the processing includes checking the ticket alert for a dig location, automatically closing the ticket alerts if the dig location is not touching a cable buffer, and forwarding the ticket alerts to the technician responsible for the ticket alert if the dig location is touching the cable buffer.

DETAILED DESCRIPTION OF THE INVENTION

Figure 1:
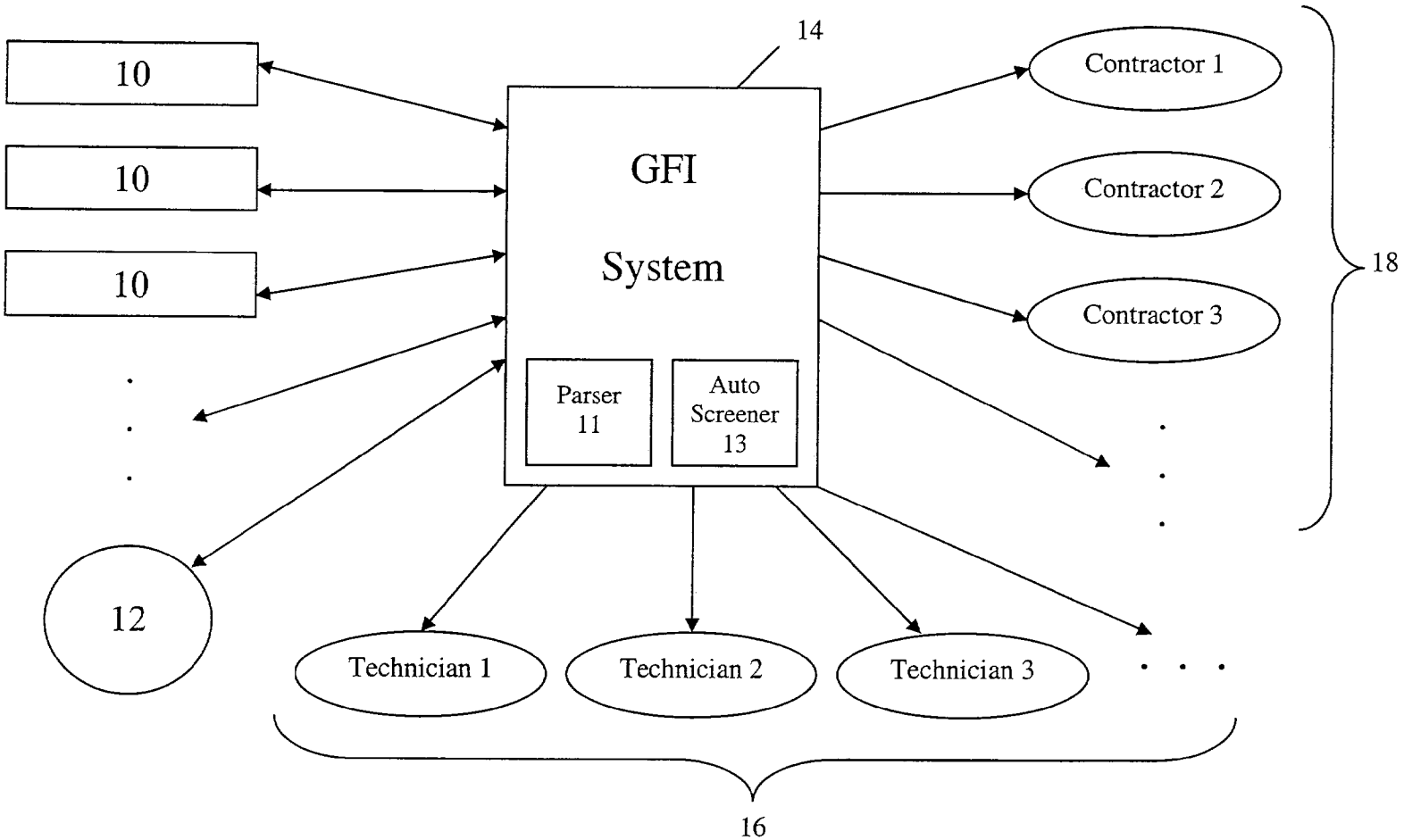
FIG. 1 is a block diagram illustrating the operation of automatic center based management for ticket alerts according to the embodiment of the present invention.
Figure 2:
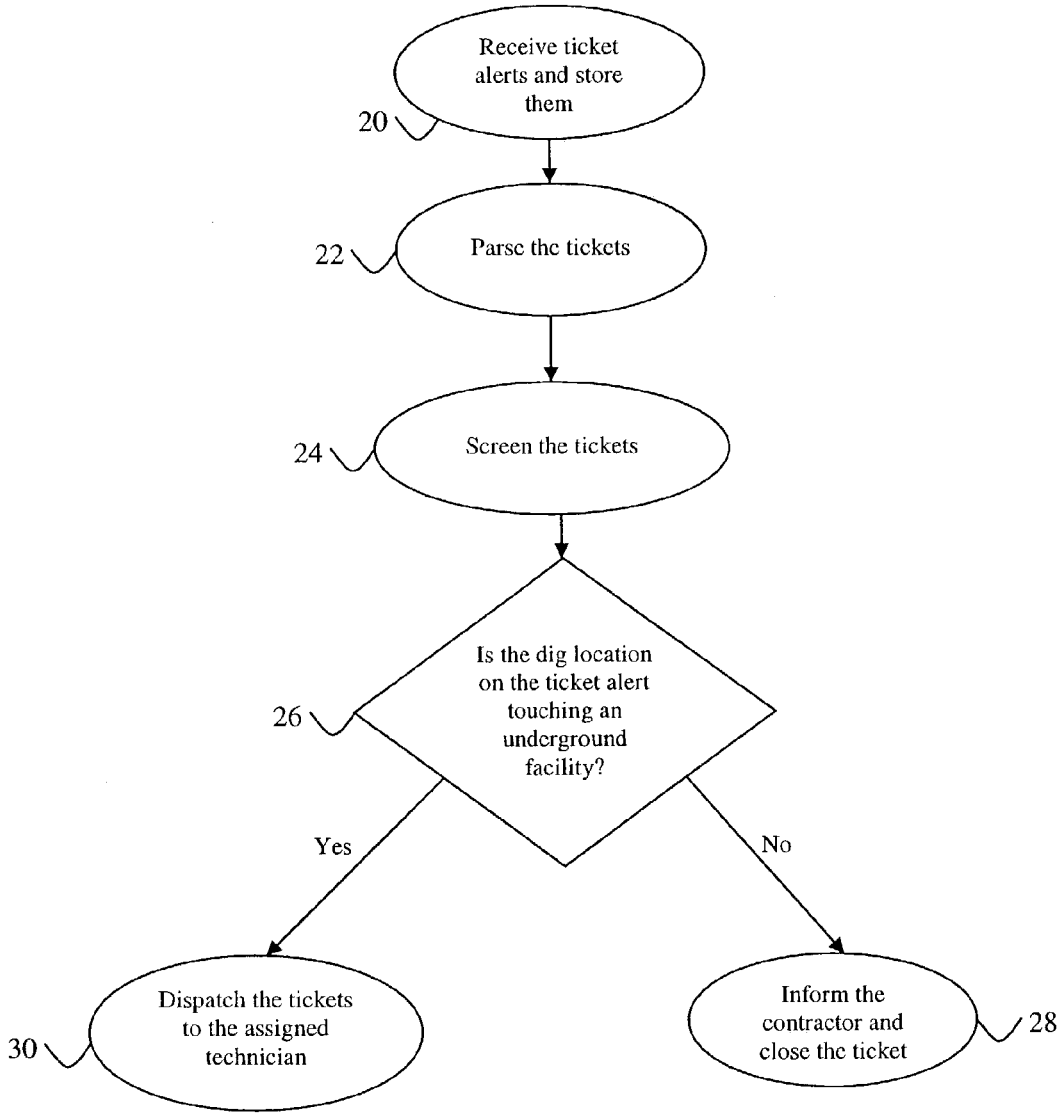
FIG. 2 is a flow chart of automatic processing of the ticket alerts according to the present invention.

Referring to FIGS. 1 and 2, in accordance with the present invention, there is shown the application and process for managing the "call before you dig" ticket alerts sent from various one call centers 10 and/or excavators 12. The ticket alerts will be received and processed at a geolink (geographical link to data) fiber integrity, ticket manager (GFI) system 14, and will then be forwarded to the technicians 16 and/or contractors 18. GFI system 14 is located at a network protection center (not shown) that provides operation services, hardware, software and system integration for the ticket alerts for various underground facilities such as cable, electric, gas, water, sewer, telecommunications, etc. Technicians 16 are individuals who are employed by the network protection center for receiving the ticket alerts and marking them as will be described in greater detail below. Whereas, contractors 18 are individuals who perform the actual digging or excavation underground and are independent of the network protection center. The GFI system 14 processes dig ticket alerts including ticket receiving, screening, distributing and ticket management. The GFI system 14 of FIG. 1 includes two main components a Parser 11 and an Auto Screener 13 as will be described more in detail below. Normally, GFI system 14 will receive around 15,000 to 20,000 dig alerts per day from 50 different one call centers 10 throughout the United States. These alerts may be sent by the one call centers 10 and/or excavator 12 through various communication means such as phone, facsimile, web, e-mail. Please note that the excavator 12 may preferably very well be the contractor 18. These alerts or tickets are received by GFI system 14, at step 20 in FIG. 2, and are then immediately stored on a file server for easy retrieval, administration and reporting. Each of these tickets are available for viewing, printing, and/or storing in a hard disk.

Figure 3:
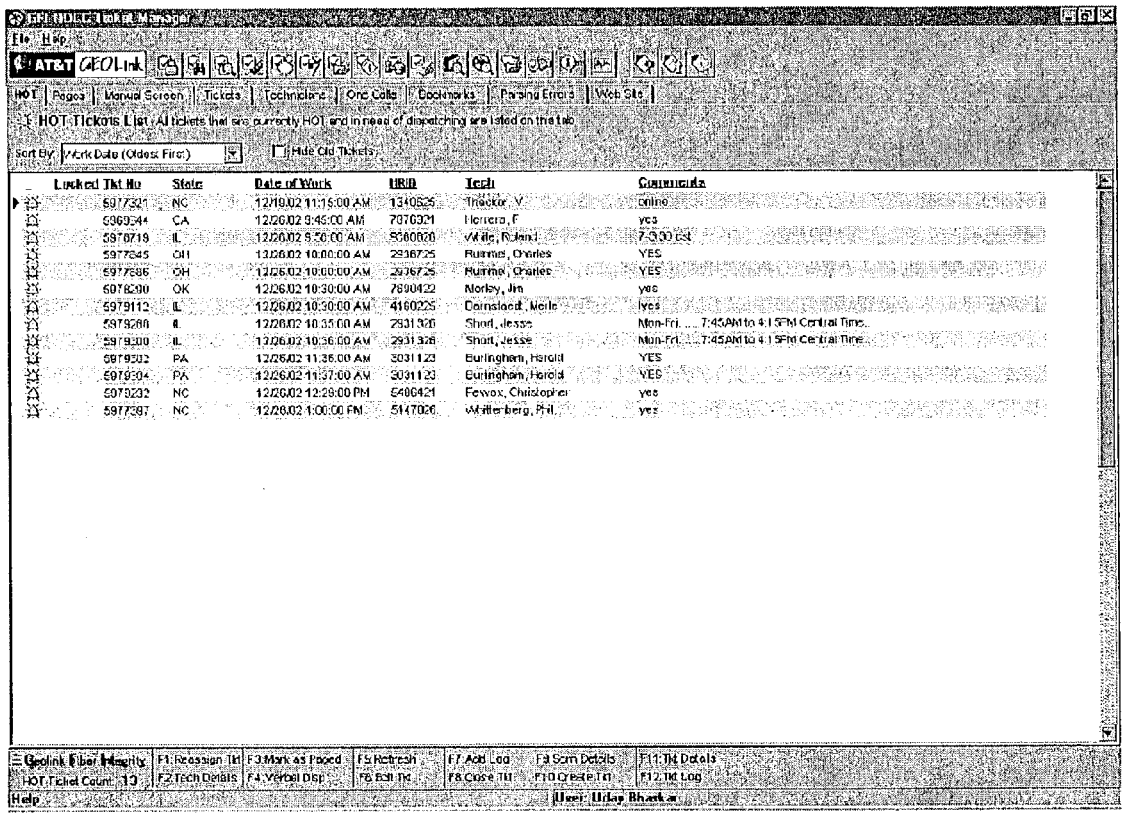
FIG. 3 is a screen shot of a list of hot tickets in accordance with the present invention.
Figure 10:
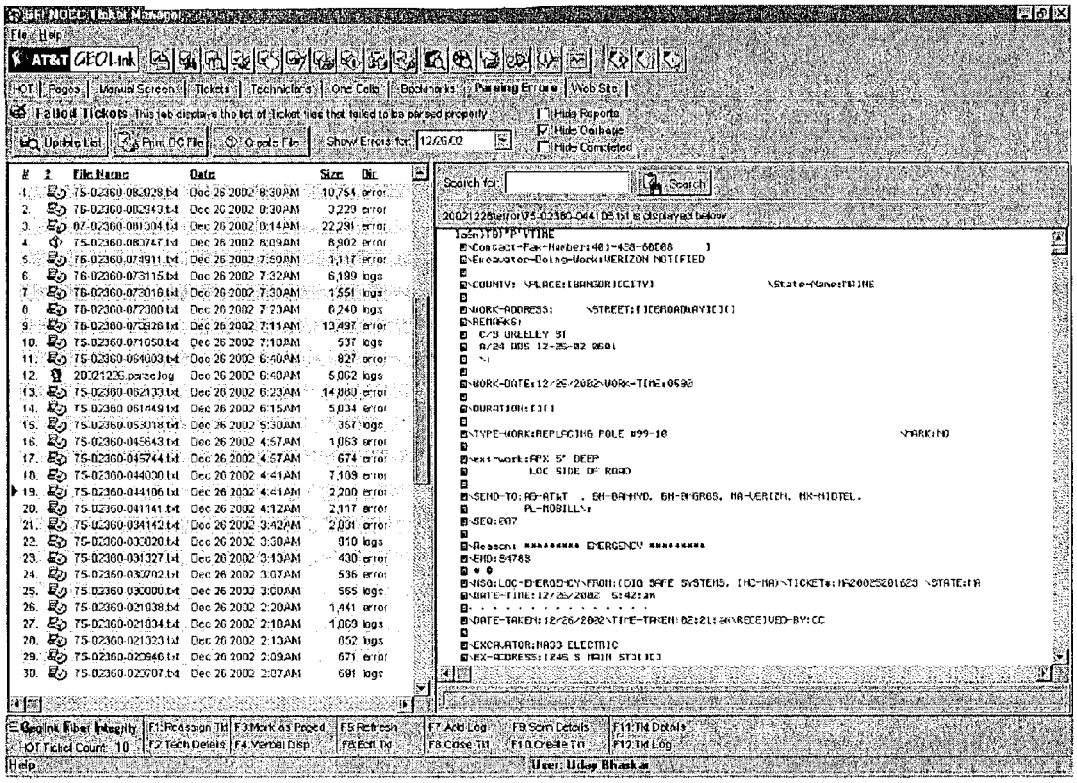
FIG. 10 shows a screen shot of a list of raw one call tickets in accordance with the present invention.
Figure 11:
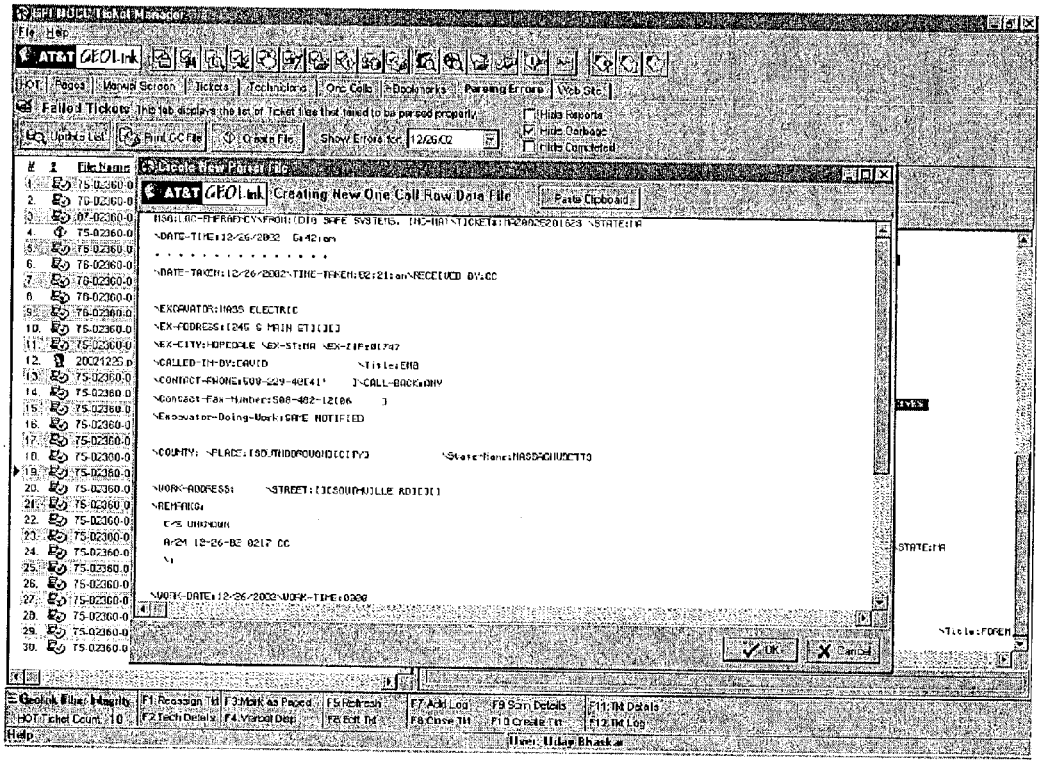
FIG. 11 shows a screen shot of resubmission of the ticket to the system according to the present invention.
Figure 12:
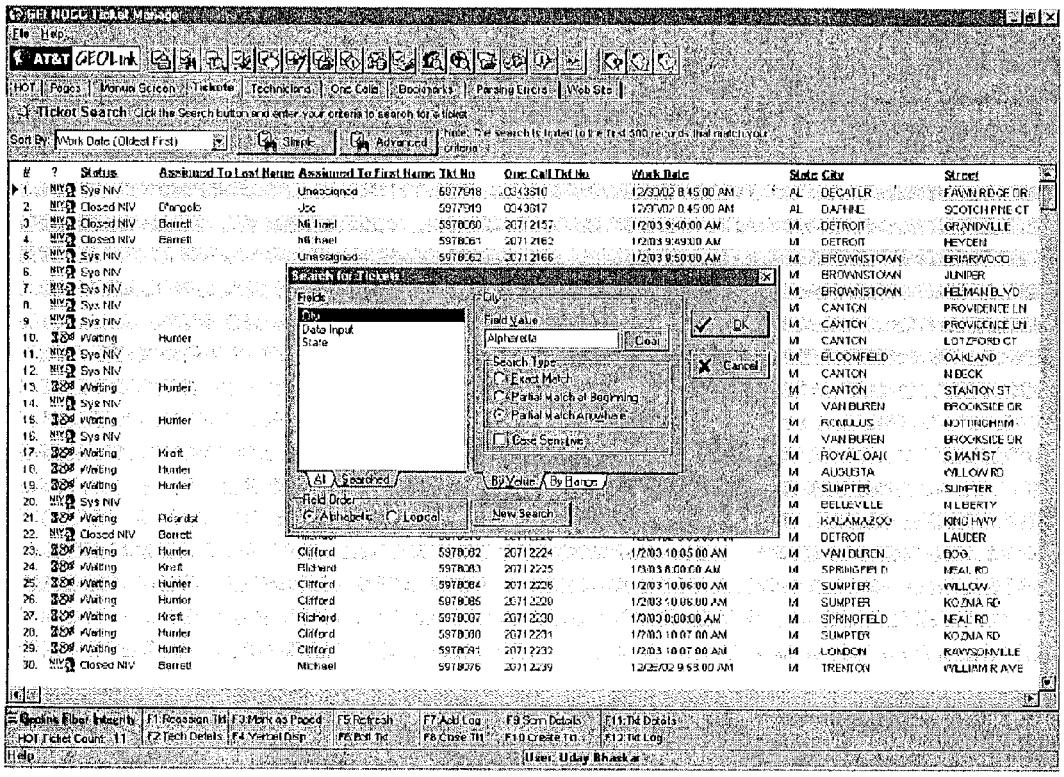
FIG. 12 illustrates a screen shot of searching the tickets in the system in accordance with the present invention.

Generally, each of the tickets will provide log information on the underground excavation or digging required to process the ticket as shown in FIG. 3. The ticket logs include information such as ticket number, dig location such as street, city, county and state, the dig date and time, grid information, excavator/contractor identification, miscellaneous comments, etc. The essential information from the ticket logs is dig location, dig date and dig time. Initially at step 22, the ticket alerts are parsed by the parser 11 of FIG. 1. Since the ticket alerts are received from several one call centers 10, these tickets will contain data in various formats. The parser 11 will read the data in these tickets and convert them into one format to generate appropriate records readable by the GFI system 14 in the database. If any tickets were failed during the parsing stage due to insufficient details provided by one call center 10 or due to some garbage content in the raw ticket, those raw one call tickets will be listed under, 'parsing errors' tab as shown in a screen shot of FIG. 10. Parsing errors may preferably have missing values in a ticket. It may also have incorrect or unreadable information such as header identifying the one call center 10, dig date and time and/or incur other transmission problems which prevents the tickets to be successfully parsed. Parser 11 will then identify the ticket numbers and problems associated with those tickets and will place them in a parsing error directory (not shown) as parsing error tickets. Users will manually go one by one to identify the problems with the parsing error tickets. If the user cannot identify and/or fix the problems, the tickets will be sent back to the one call center 10. However, if the user can identify and fix the problems, the user will create a new one call raw data file and resubmit to the parser 11 for parsing one more time. Therefore, users are capable of submitting those tickets to the parser of the GFI system 14 after completing the remaining details by checking the error log file. FIG. 11 shows a typical example of resubmitting a ticket to the system after completing the required details through "parsing error" tab.

After the tickets have parsed successfully through the parsing stage, at step 22, they are received by an Auto Screener 13 of FIG. 1, which will automatically screen the tickets at step 24. The Auto Screener 13 will follow algorithms to make certain that the ticket log contains essential information needed to automatically process the raw ticket contents and/or the essential information in the ticket log is correct. As mentioned earlier, the essential information includes dig location, such as city, street, county and state, dig date and time. During screening, if it is determined that the one call center 10 failed to provide one or more of the required details, and/or the details provided are incorrect, then those tickets will be in queue for manual screening. The process of manual screening is described in more detail below.

Figure 6:
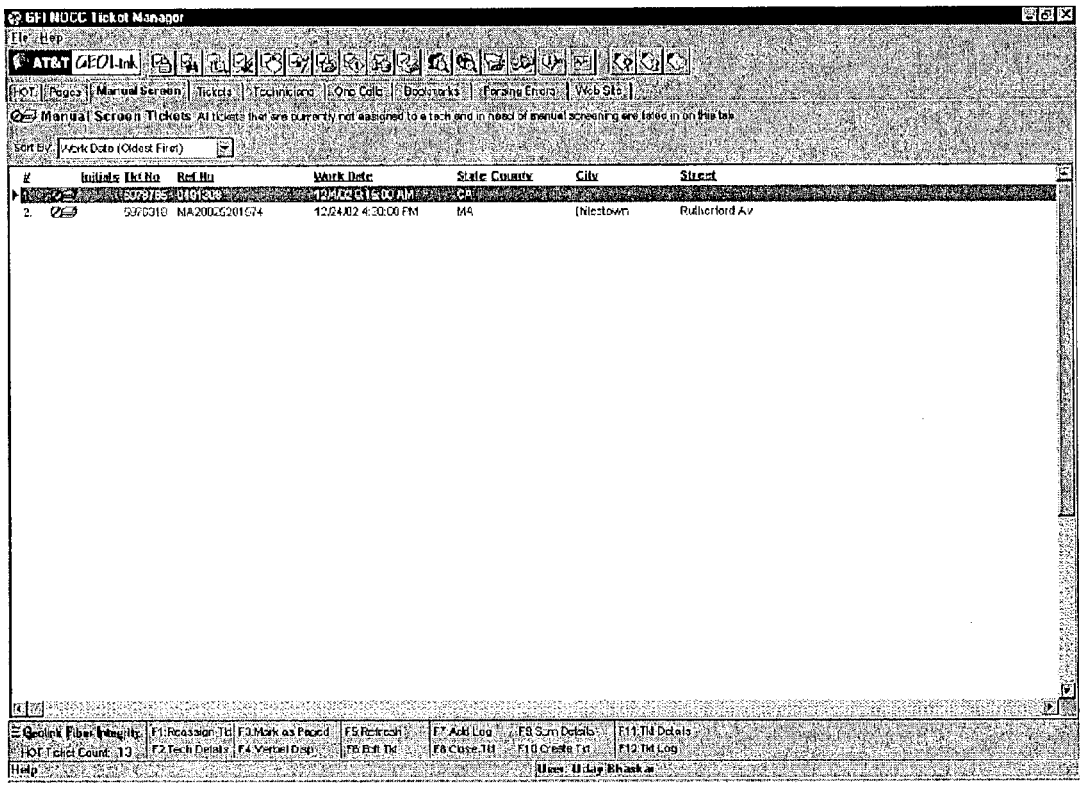
FIG. 6 is a screen shot of a list of tickets requiring manual screening in accordance with the present invention.
Figure 8:
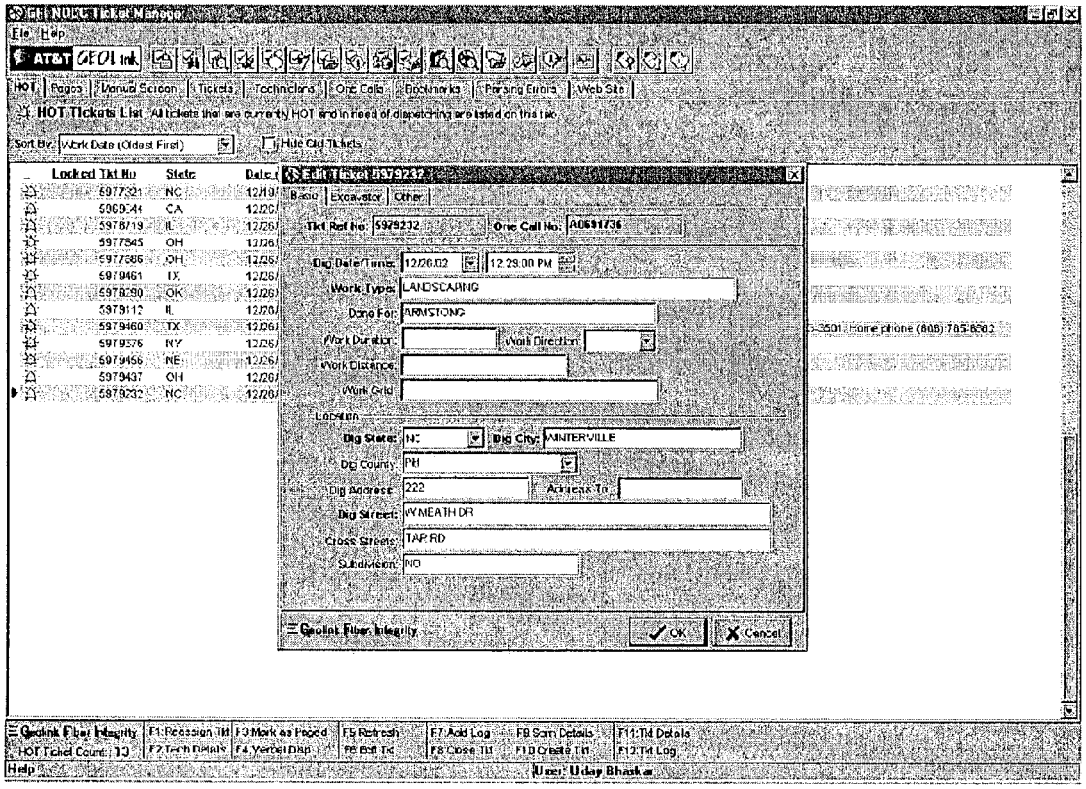
FIG. 8 is a screen shot showing the editing of the ticket details according to the present invention.
Figure 9:
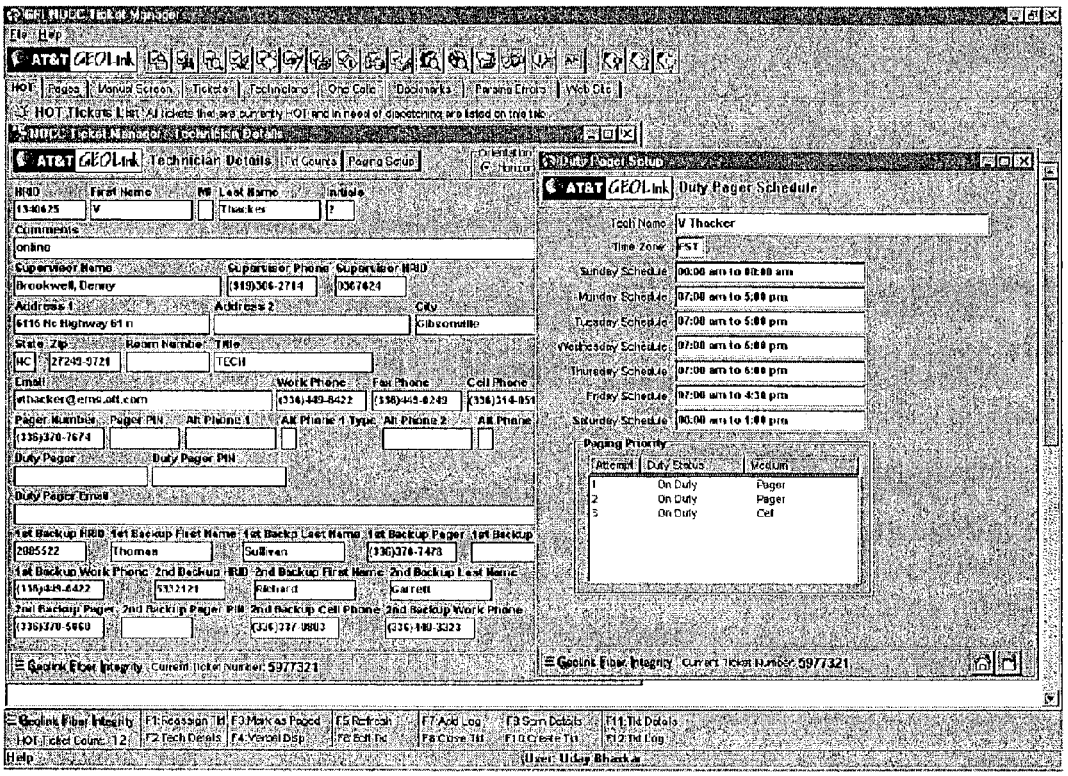
FIG. 9 is a screen shot illustrating the viewing/editing of the technician details according to the present invention.

As mentioned above, the tickets that have one or more required details missing in the ticket log are sent for manual screening. Users are able to view the list of tickets waiting for manual screening. FIG. 6 shows a screen shot of an example of list of tickets waiting for manual screening. These manual screen tickets are tickets that are currently not assigned to any technician and are in need of manual screening by a user. Normally, on an average 1 to 5 tickets will be in queue for manual screening out of 15,000–20,000 tickets received per day. Users of GFI system 14 are capable of adding the missing details in those tickets and can resubmit these tickets to the auto screener 13 again to be screened. Users can also edit ticket details. A screenshot of a ticket being edited by the user is shown in FIG. 8. For example, if any ticket is marked with wrong dig date and time, users have the capability to change the date time and can resubmit the ticket to the auto screener 13. Furthermore, as shown in a screenshot in FIG. 9, users can also view and edit the technician 16 details which are responsible for any ticket and can change the technician's auto paging schedule or vacation schedule if necessary.

Figure 7:
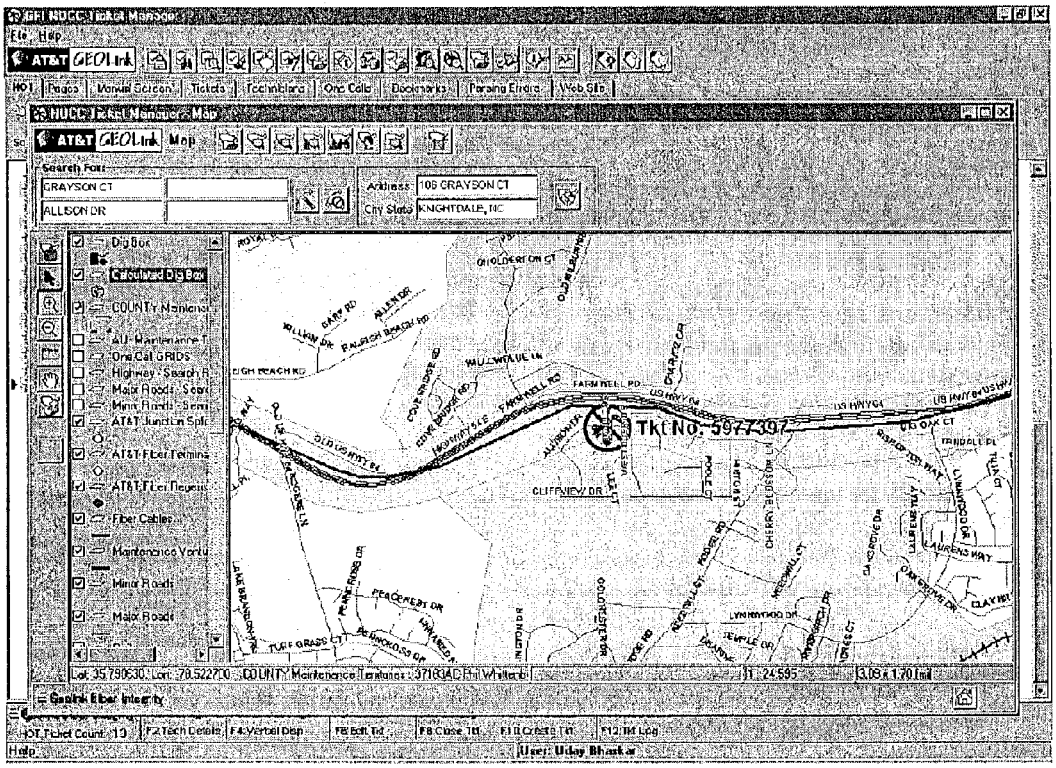
FIG. 7 is a screen shot illustrating viewing the dig location on the map according to the present invention.

Returning back to the initial screening done by the auto screener 13, if it is determined that the required details are not missing in the ticket alert, then the GFI system 14 will first check if the dig location in the ticket is touching the cable buffer or another underground facility. In other words, the system checks if the dig location falls within a tolerance zone of the facility which may preferably be the width of the facility plus, a specific feet on either side. FIG. 7 is an example of a map used to view the dig location of any ticket in the map. It is to be understood that one can zoom in and out of the map to find streets, highways, boundaries, etc. The tolerance zone data with the system mapping is stored in a GFI database of the GFI system 14, allowing to visualize where the facilities are in relation to the geographical features such as street and township boundaries, township range sections, and so on. If the dig location does not fall under the tolerance zone, the auto screener 13 will close the ticket and send instructions to the system to go ahead and inform the excavator/contractor 18 assigned to the ticket of the same. Upon receipt of the instructions, the system will automatically inform the assigned contractor 18 of the same at step 28 of FIG. 2.

However, if it is determined at step 26, that the dig location on the ticket is touching an underground facility, then the auto screener 13 will assign the ticket to the appropriate technician 16. Upon receipt of the instruction, the system at step 30 of FIG. 2 will automatically dispatch the tickets to the assigned technicians 16. The technicians 16 will be notified about the tickets via several sources such as pager, regular phone, cell phone, PC, etc. The technicians 16 may preferably select an auto paging schedule, i.e. choose to assign these sources in some order or form. For example, the technician 16 can select to be informed of the ticket first by a pager, then by cell phone and last by his home phone. This auto paging schedule can be stored in the database with the technician 16 so when the auto screener 13 sends the instructions to inform the specific technician 16, the GFI system 14 can pull out the auto paging schedule of that technician 16 and inform him/her accordingly.

The technician 16 will download the ticket from the system, mark the tickets and notify the contractor 18 of the same so the contractor 18 may begin excavating. The technician 16 will then close the ticket on the GFI system 14. If the technician 16 observed from the ticket log in the ticket that the dig location was not near a cable or other underground facility, the technician 16 will preferably immediately close the ticket on the GFI system 14.

Once the technician 16 is notified of the ticket, he or she will preferably log into the GFI system 14 using the On Site Work Force application (not shown) and download the tickets. The technician 16 will then complete his/her work and close the ticket on the GFI system 14 using the On Site Work Force application. If the technician 16 observed from the ticket log, in the ticket that the dig location is not near a cable or any other underground facility, he/she will preferably close the ticket on the GFI system 14 immediately using the On Site Work Force Application.

Figure 15:
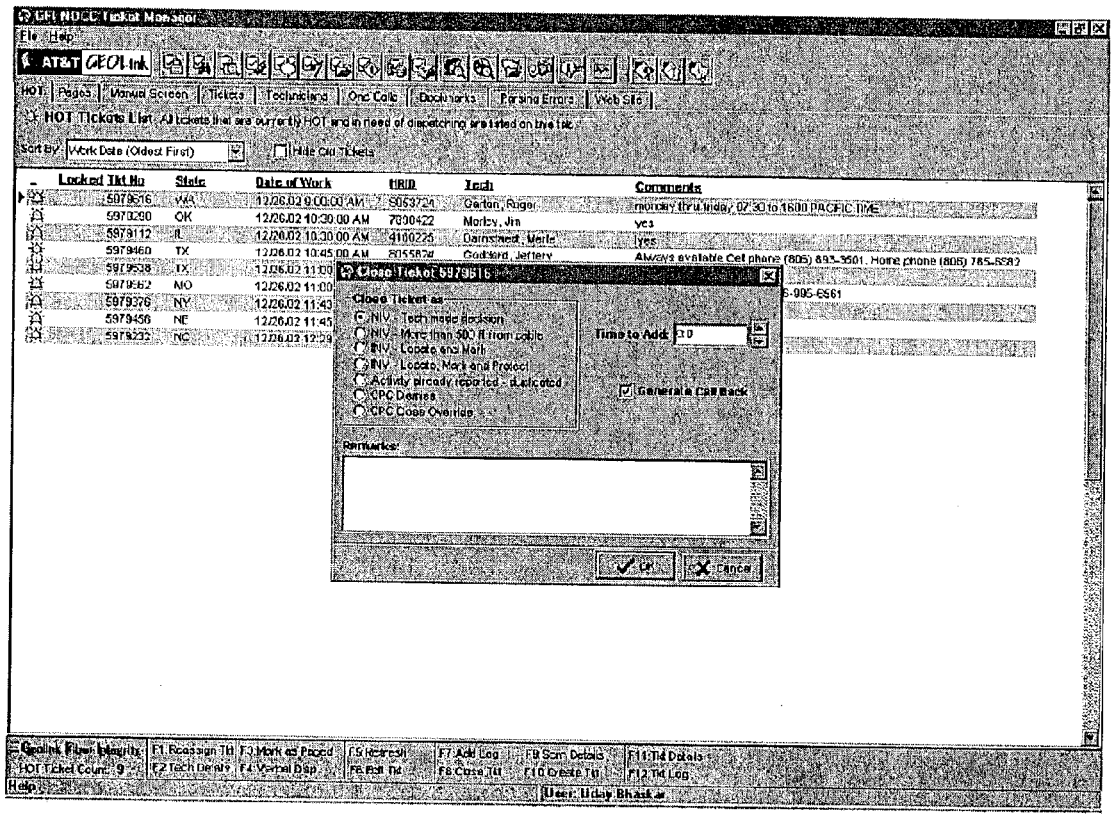
FIG. 15 shows a screen shot illustrating closing the ticket according to the present invention.

Under some circumstances, if the ticket is not downloaded by the technician 16, the user of the GFI system 14 will verbally dispatch the tickets. In other words, the user will contact the technician 16 and verbally give details of the ticket from the ticket log. Upon receiving the details from the user, the technician 16 will determine if the dig location is near or touching an underground facility. If the dig location is not touching the facility, the technician 16 may preferably instruct the user to close the ticket. This is a very rare instance when the user will have the capability to close the ticket in the system. Another instance which occurs rarely is when the contractor 18 contacts the user notifying him/her that the digging work for the ticket alert has cancelled. Then the user will preferably close the ticket in the system and notify the technician 16 of the same. An example of the user closing the ticket is shown in FIG. 15. There is shown a pop-up screen of "Close Ticket" for ticket #5379616. This ticket is being closed by the user as "Tech made decision". As discussed above, often, the tickets are closed because the dig location is more than 500 feet from the cable, i.e., not touching the cable buffer. Sometimes, users are able to close a ticket if they found it as a duplicate ticket before a technician 16 downloads that ticket.

Figure 4:
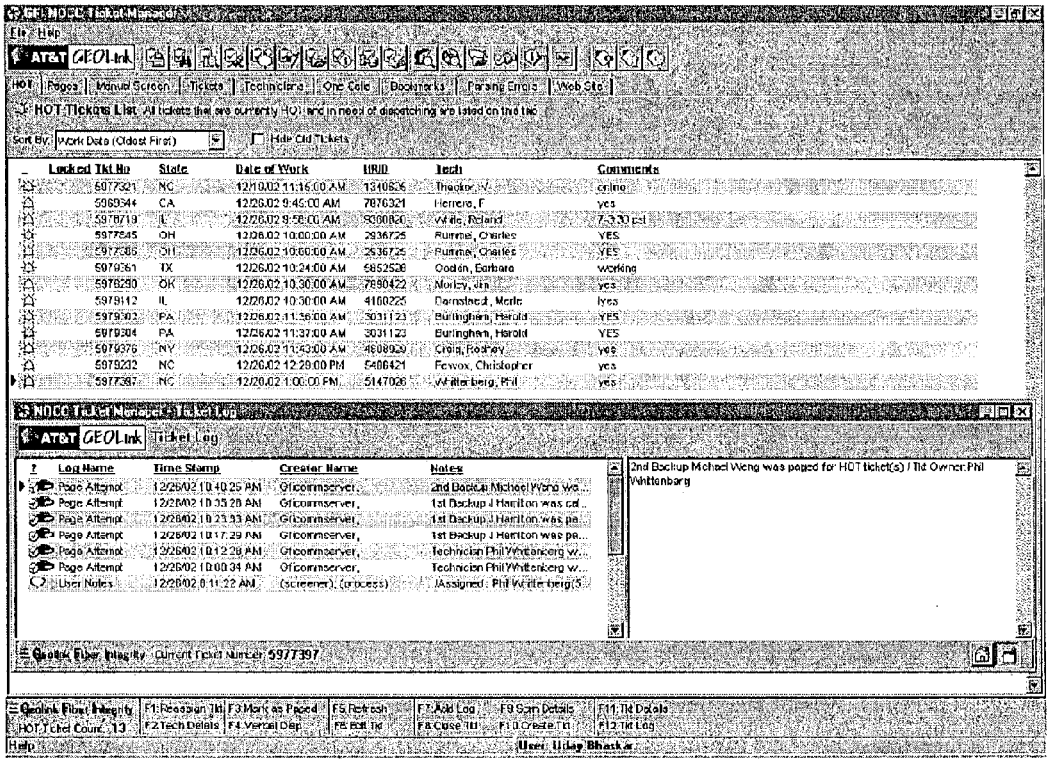
FIG. 4 is a screen shot of ticket log details according to the present invention.

FIG. 3 shows a screen shot of an example of list of tickets called hot tickets. Hot tickets are defined as the tickets that are within 2 working hours of their due time or are marked by the one call center 10 as requiring an emergency response. During the screening of the tickets, the auto screener 13 determines whether the ticket is a hot ticket or not. If it is determined that the ticket alert is a hot ticket, then the ticket alert is immediately processed. The processing of the hot ticket includes the GFI system 14 users viewing the ticket log details of each individual ticket shown in the bottom screen of FIG. 4 such as, who is the technician responsible for this ticket, what are the screening methods used to assign the ticket to a particular technician, the auto paging attempts made for this technician to download this ticket, any prior reassignment(s) of this ticket, if any other technicians initially downloaded it etc. and further dispatching the ticket to the assigned technician 16 in step 30 of FIG. 2 according to the technician's paging schedule. Note that the hot tickets will almost always have all detail information needed including the date and time and the digging location of hot tickets will be touching the cable.

Figure 5:
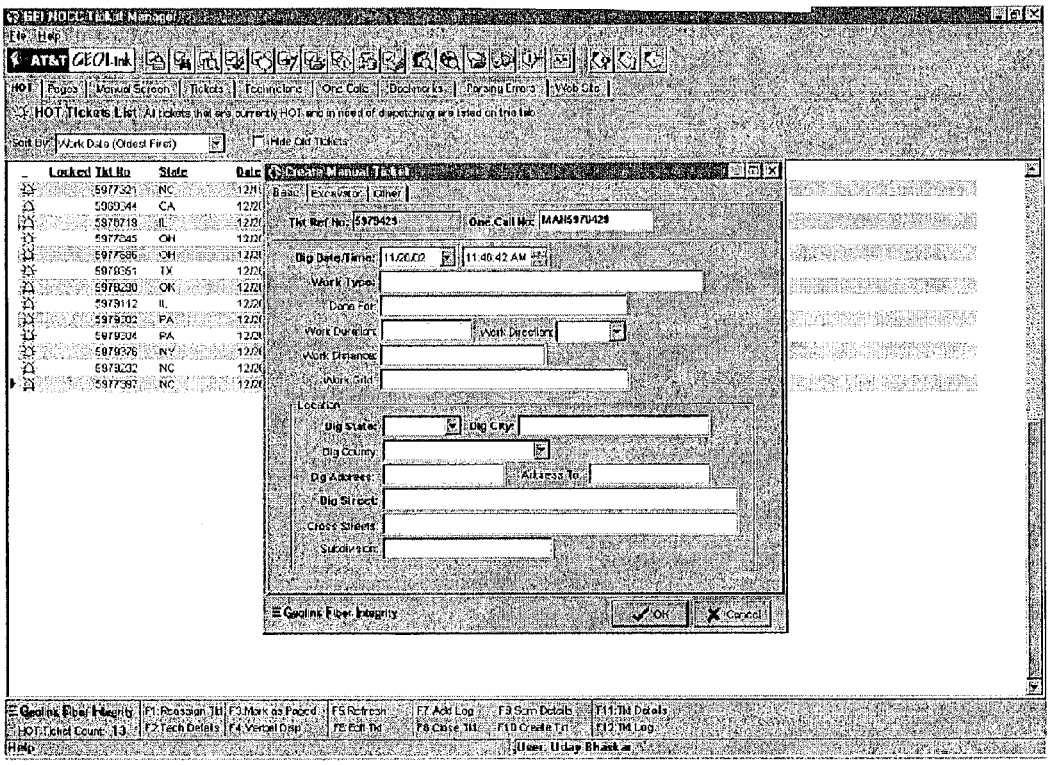
FIG. 5 is a screen shot of an example of manual ticket in accordance with the present invention.

Sometimes users of the GFI system 14 are able to create a manual ticket such as shown in FIG. 5 if they did not receive any notification on the emergency dig going on in a certain place from the one call center 10. This will happen when an excavator 12 contacts the GFI system 14 and directly informs about the dig location during emergency situations. The manual ticket of FIG. 5 shows blank fields which require to be filled out in order to automatically process the ticket. The user manually inputs all the required data on these blank fields, thereby creating the manual ticket which is automatically processed and the appropriate technician 16 is notified immediately about the emergency dig information.

Figure 13:
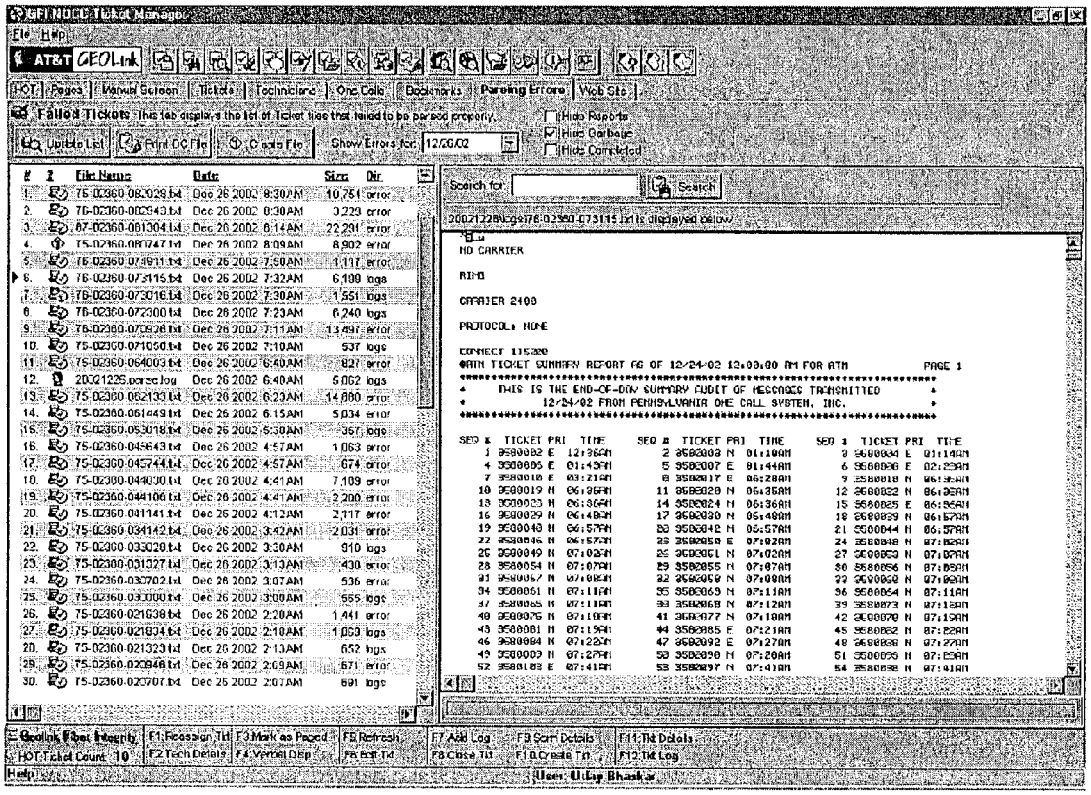
FIG. 13 is a screen shot of the ticket audit reports in accordance with the present invention.

Furthermore, auditing of one call tickets is preferably done on a daily basis to find out the list of missing tickets in the GFI system 14. One call centers 10 send daily reports preferably at the end of the day to the GFI system 14, which contains a listing of tickets with their corresponding ticket numbers that were sent out on previous business day. These audit reports as shown in FIG. 13 can be found in 'Parsing Errors' tab in the GFI system 14. Users will check to see if any of these tickets are missing in the system by sending all the reports to a component called Ticket Audit Report. Ticket Audit Report is a component in the GFI system 14 which determines whether the tickets in the report are missing in the system. If so, the user will be informed of the same and the one call center 10 will be contacted to resubmit the missing tickets.

Figure 14:
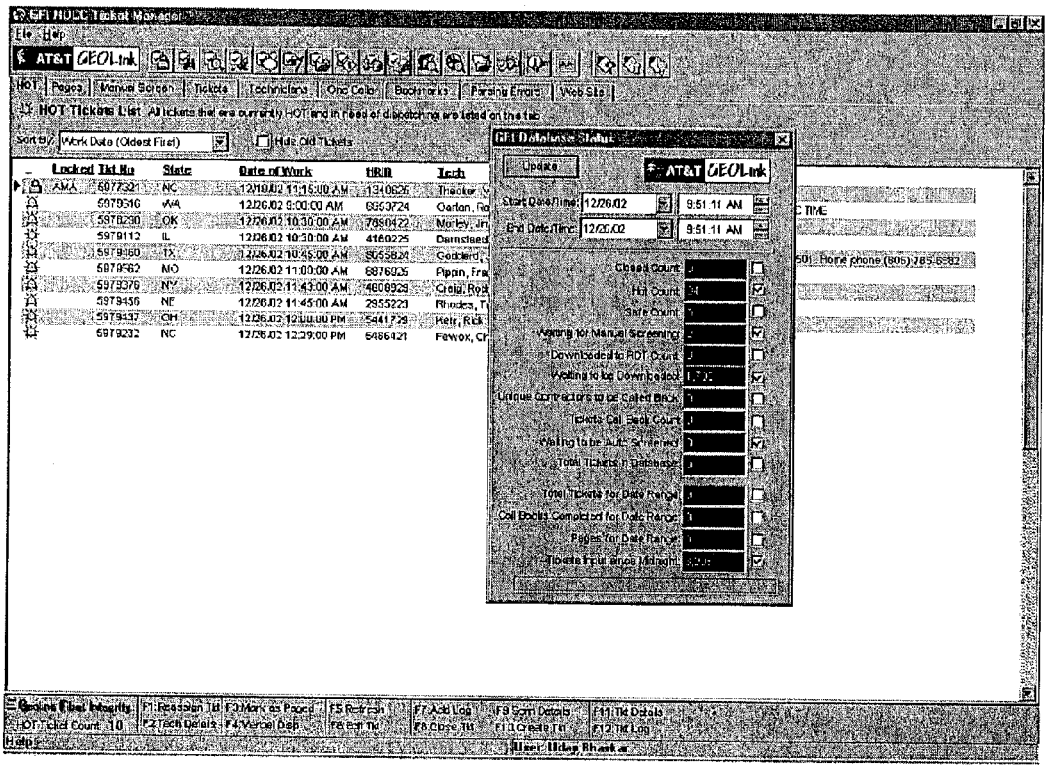
FIG. 14 shows a screen shot of the system statistics details in accordance with the present invention.

Referring to FIG. 14, the GFI system 14 includes statistics information listing various options in the GFI database as hot ticket count, safe ticket count, waiting for manual screening, waiting to be downloaded, waiting to be auto screened, total tickets in the system, tickets received since midnight etc. details which are required to analyze the system are readily available in GFI system 14. If any user is making some changes to a ticket such as editing the work date and time or changing the dig location or changing the excavator information, this ticket will be locked and protected as one of the options in FIG. 14, and will not be available for any further edits before the user unlocks the ticket. During this period, this ticket can only be viewed as read only.

While the invention has been described in relation to the preferred embodiments with several examples, it will be understood by those skilled in the art that various changes may be made without deviating from the spirit and scope of the invention as defined in the appended claims.

What is claimed is:

1. A method for automatically managing ticket alerts to prevent damaging of underground facilities, comprising:

receiving said ticket alerts from various sources, wherein said ticket alerts comprise a notification of underground excavation;

automatically processing each said ticket alert at a network center solely using a GFI ticket manager application system; wherein said processing includes checking the ticket alerts for a dig location, automatically closing the ticket alerts if the dig location is not touching a cable buffer, and forwarding the ticket alerts to a technician responsible for the ticket alert if the dig location is touching the cable buffer.

2. The method of claim 1 further comprising:

receiving instructions from the technician to close the ticket alert.

3. The method of claim 1, wherein said processing further comprises:

checking the ticket alerts for at least one required information item needed for processing the ticket alert, wherein said required information item includes dig date, dig time, dig location, or a combination thereof;

sending the ticket alert for manual screening if the required information item is not provided.

4. The method of claim 3 wherein said manual screening comprises:

manually adding the required information item in the ticket alert and resubmitting the ticket alerts for said processing.

5. The method of claim 3 further comprising:

editing the ticket alerts including the required information item in the ticket alert;

resubmitting the edited ticket alerts for said processing, wherein said edited ticket alerts are locked and prevented from further editions.

6. The method of claim 5 further comprising:

reassigning the edited tickets to appropriate technician.

7. The method of claim 1 further comprising:

receiving an audit report including a list of the ticket alerts from said sources;

monitoring the list for ticket alerts missing in the GFI application;

contacting said sources to resubmit the missing ticket alerts;

receiving the missing ticket alerts; and submitting the missing ticket alerts for said processing.

8. The method of claim 1 further comprising:

checking the ticket alerts for hot tickets; wherein said hot tickets include ticket alerts that require emergency response;

immediately processing the hot tickets solely using the GFI ticket manager application; and dispatching the processed hot ticket to an assigned technician.

9. The method of claim 3 further comprising:

receiving notification of emergency digging from the technician;

creating a manual ticket alert based on said notification wherein said manual ticket alert includes a user manually inputting the required information item needed to process the ticket alert.

10. The method of claim 1 wherein said GFI application comprises statistics information of the ticket alerts including hot ticket count, safe ticket count, total tickets, tickets received since period of time, waiting for manual screening, waiting to be downloaded, waiting to be autoscreened or combination thereof.

11. A system for automatically managing ticket alerts to prevent damaging of underground facilities, comprising:

a network center for receiving said ticket alerts from one call center, wherein said ticket alerts comprise a notification of underground excavation and said network center comprises a GFI ticket manager application for automatically processing the ticket alerts; wherein said processing includes checking the ticket alerts for a dig location, automatically closing the ticket alerts if the dig location is not touching a cable buffer, and forwarding the ticket alerts to a technician responsible for the ticket alert if the dig location is touching the cable buffer.

12. The system of claim 11 wherein said GFI ticket manager application further comprises:

a parser for parsing the ticket alerts received from the one call centers including converting data in the ticket alerts to a format readable by the GFI ticket manager application and checking the data for any errors preventing the tickets to be successfully parsed.

13. The system of claim 12 wherein said GFI ticket manager application further comprises:

an autoscreener for receiving the successfully parsed ticket alerts, screening said successfully parsed ticket alerts for at least one required information item needed for processing the ticket alerts, and sending the ticket alerts for manual screening if the required information item is not provided wherein said required info includes dig date, dig time, dig location, technician or a combination thereof.

14. The system of claim 13 wherein said auto screener checks the ticket alerts for hot tickets and further informs the GFI ticket manager application for immediate processing of said hot tickets, wherein said hot tickets include ticket alerts that require emergency response.

15. The system of claim 11 wherein said GFI ticket manager application further comprises:

an onsite work force application for downloading the ticket alerts to the technician responsible for the ticket alert and closing the ticket alerts on the system.

16. The system of claim 11 wherein said GFI ticket manager application includes a ticket audit report for monitoring a list for ticket alerts missing in the GFI ticket manager application and informing the GFI ticket manager application of the missing ticket alerts, wherein said list includes all ticket alerts sent by said one call centers.

17. The system of claim 16 wherein said GFI ticket manager application contacts the one call centers to resubmit the missing ticket alerts for processing.

18. The system of claim 11 wherein said GFI application comprises statistics information of the ticket alerts including hot ticket count, safe ticket count, total tickets, tickets received since period of time, waiting for manual screening, waiting to be downloaded, waiting to be autoscreened or combination thereof.

* * * * *